United States Patent [19]

Hisamoto et al.

[11] 4,124,517

[45] Nov. 7, 1978

[54] DRY CLEANING COMPOSITION

[75] Inventors: Iwao Hisamoto, Suita; Chiaki Maeda; Takayuki Deguchi, both of Settsu; Yukio Omure, Takatsuki; Takasi Onishi, Higashi-Osaka, all of Japan

[73] Assignee: Daikin Kogyo Kabushiki Kaisha, Osaka, Japan

[21] Appl. No.: 723,249

[22] Filed: Sep. 15, 1976

[30] Foreign Application Priority Data

| | | | |
|---|---|---|---|
| Sep. 22, 1975 | [JP] | Japan | 50-115315 |
| Dec. 25, 1975 | [JP] | Japan | 50-157934 |
| Apr. 16, 1976 | [JP] | Japan | 51-44082 |

[51] Int. Cl.[2] ..... C11D 1/40; C11D 1/44

[52] U.S. Cl. ..... 252/89 DC; 8/142; 252/8.75; 252/8.8; 252/153; 252/544; 252/548

[58] Field of Search ..... 252/89 DC, 544, 153, 252/8.8, 548, 8.75; 8/142

[56] References Cited

U.S. PATENT DOCUMENTS

| | | | |
|---|---|---|---|
| 3,523,749 | 8/1970 | MacLeod et al. | 8/94 X |
| 3,933,425 | 1/1976 | Grunewalder et al. | 8/142 |
| 3,950,277 | 4/1976 | Stewart et al. | 252/548 X |
| 3,962,152 | 6/1976 | Dekken et al. | 252/548 |

*Primary Examiner*—Thomas J. Herbert, Jr.
*Attorney, Agent, or Firm*—Larson, Taylor and Hinds

[57] ABSTRACT

A dry cleaning composition comprising as effective components a fluorine-containing hydrocarbon solvent and at least one surfactant selected from the group consisting of organic acid salts of monoamines represented by the formula

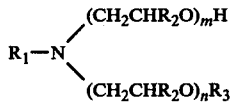

(I)

wherein $R_1$ is alkyl having 6 to 20 carbon atoms, $R_2$ is hydrogen atom or $CH_3$, $m$ and $n$ are each zero or an integer of 1 to 20, and are further defined by $3 \leqq m + n \leqq 20$, $R_3$ is hydrogen atom or alkyl having 6 to 20 carbon atoms when $n$ is zero and $R_3$ is hydrogen atom when $m$ is 1 to 20, and organic acid salts of diamines represented by the formula

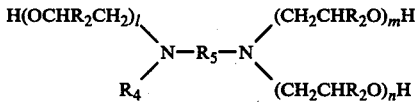

(II)

wherein $R_2$ is as defined above, $R_4$ is alkyl having 6 to 20 carbon atoms, $R_5$ is alkylene having 2 to 6 carbon atoms, $l$ is zero or an integer of 1 to 20, $m$ and $n$ are as defined above, and $3 \leqq l + m + n \leqq 20$.

16 Claims, No Drawings

DRY CLEANING COMPOSITION

This invention relates to dry cleaning compositions, and more particularly to dry cleaning compositions containing a fluorine-containing hydrocarbon solvent.

When various materials for clothes and the products thereof are dry-cleaned with use of perchloroethylene, trichloroethylene, trichlorotrifluoroethane and like hydrocarbon halide solvents and petroleum hydrocarbon solvents, a small amount of surfactant is usually added to the solvent to enhance the cleaning effect.

Generally the surfactants to be added to dry cleaning solvents must have the properties of effectively removing mainly water-soluble soils and preventing redeposition of water-soluble and oil-soluble soils. It is further required that the surfactants be capable of stably solubilizing or emulsifing at least a specified amount of water in the solvent and that they do not impair the hand of the articles cleaned. Although various surfactants have heretofore been developed for this purpose, they remain yet to be improved in the above-mentioned properties required. It is therefore desired to provide excellent surfactants fulfilling the foregoing requirements.

The main object of this invention is to provide surfactants having all the desired properties referred to above and to provide dry cleaning compositions containing such surfactant.

Another object of this invention is to provide dry cleaning compositions for effectively removing water-soluble soils.

Another object of this invention is to provide dry cleaning compositions for effectively preventing redeposition of water-soluble and oil-soluble soils on the articles to be cleaned.

Another object of this invention is to provide dry cleaning compositions permitting at least a specified amount of water to be retained in the constituent solvent thereof as stably solubilized or emulsified in the solvent.

Another object of this invention is to provide dry cleaning compositions which will not impair the hand of the articles to be cleaned.

Still another object of this invention is to provide dry cleaning compositions which is very excellent in antistatic charge.

These and other objects and features of this invention will become apparent from the following description.

The objects of this invention can be fulfilled by a dry cleaning composition comprising as effective components a fluorine-containing hydrocarbon solvent and at least one surfactant selected from the group consisting of organic acid salts of monoamines represented by the formula

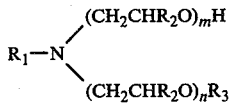

(I)

wherein $R_1$ is alkyl having 6 to 20 carbon atoms, $R_2$ is hydrogen atom or $CH_3$, $m$ and $n$ are each zero or an integer of 1 to 20, and are further defined by $3 \leqq m + n \leqq 20$, $R_3$ is hydrogen atom or alkyl having 6 to 20 carbon atoms when $n$ is zero and $R_3$ is hydrogen atom when $m$ is 1 to 20, and organic acid salts of diamines represented by the formula

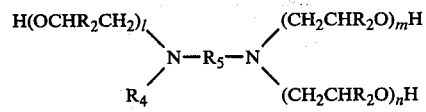

(II)

wherein $R_2$ is as defined above, $R_4$ is alkyl having 6 to 20 carbon atoms, $R_5$ is alkylene having 2 to 6 carbon atoms, $l$ is zero or an integer of 1 to 20, $m$ and $n$ are as defined above, and are further defined by $3 \leqq l + m + n \leqq 20$.

Our research has revealed that the composition prepared by incorporating at least one of the organic acid salts of amines represented by the formulae (I) and (II) into a fluorine-containing hydrocarbon solvent greatly facilitates removal of water-soluble soils, effectively prevents redeposition of water-soluble and oil-soluble soils on the articles to be cleaned, permits at least a specified amount of water to be stably solubilized or emulsified and retained in the composition and in no way impairs the hand of the articles.

The ability of dry cleaning compositions to retain water as stably sulbilized or emulsified therein results in the following advantages. Generally the dry cleaning system contains the water introduced into the cleaning apparatus along with the article to be cleaned. When such water is not stably solubilized or emulsified in the dry cleaning solvent or is separated in a short period of time after it has been solubilized or emulsified in the solvent, water-soluble soils solubilized in such separated water often stain the article. It is also known that use of a solvent containing some amount of water stably solubilized or emulsified therein removes water-soluble soils with improved effectiveness. Since a large amount of water can be solubilized or emulsified with improved stability in the compositions of this invention, the compositions produce no stains and are easily usable in the usual manner in which some water is added to the solvent to afford an improved cleaning effect.

The organic acid salts of the amines represented by the formula (I) are obtained by the usual acid-base reaction between the amines and organic acids.

In the formula (I) representing the monoamines, $R_1$ is alkyl group having 6 to 20 carbon atoms, preferably 8 to 20 carbon atoms. The alkyl may be in the form of a straight chain or branched chain, or saturated or unsaturated one. The element or group represented by $R_2$ is hydrogen atom or methyl group. The constituents $R_2$ contained in one molecule of the amine may all be hydrogen atoms or methyl groups, or may comprise both hydrogen atom and methyl group. $m$ and $n$ are each zero or an integer of 1 to 20, and $3 \leqq m + n \leqq 20$, preferably $5 \leqq m + n \leqq 15$. If $m + n$ is less than 3, the desired effect of this invention is not attainable. Further when $n$ is zero, $R_3$ is hydrogen atom or alkyl group having 6 to 20 carbon atoms. The alkyl group may be the same as one represented by $R_1$. When $n$ is an integer of 1 to 20, $R_3$ is hydrogen atom. Table 1 shows typical examples of the monoamines represented by the formula (I).

Table 1

| Compound No. | $R_1$ | $R_2$ | $R_3$ | m + n |
|---|---|---|---|---|
| 1 | $C_8H_{17}$ | H | $C_8H_{17}$ | 3 |
| 2 | $C_{12}H_{25}$ | H | $C_6H_{13}$ | 15 |
| 3 | $C_{12}H_{25}$ | H | $C_{12}H_{25}$ | 18 |
| 4 | $C_6H_{13}$ | H | H | 3 |
| 5 | $C_8H_{17}$ | H | H | 4 |
| 6 | $C_{12}H_{25}$ | H | H | 6 |
| 7 | $C_{14}H_{29}$ | H | H | 10 |
| 8 | $C_{18}H_{37}$ | H | H | 5 |

Table 1-continued

| Compound No. | $R_1$ | $R_2$ | $R_3$ | m + n |
|---|---|---|---|---|
| 9 | $C_{18}H_{37}$ | H | H | 12 |
| 10 | $C_{18}H_{35}$ | H | H | 5 |
| 11 | $C_{18}H_{35}$ | $CH_3$ | H | 5 |
| 12 | $C_{18}H_{35}$ | H | H | 15 |

Various organic acids are usable as the organic acids to be reacted with the monoamines of the formula (I). Table 2 below shows preferable examples.

Table 2

| Organic acid | |
|---|---|
| $R_6COOH$ | $R_6$: alkyl having 1 to 20 carbon atoms. |
| $R_7O(CH_2CH_2O)_{p'}$ \ POOH / $R_7O(CH_2CH_2O)_{p'}$ | $R_7$: alkyl having 1 to 20 carbon atoms. p': zero or integer of 1 to 15. |
| $R_8CONCH_2COOH$ (with $CH_3$) | $R_8$: alkyl having 1 to 20 carbon atoms. |
| $R_9OCOCH_2$ / $R_9OCOCHSO_3H$ | $R_9$: alkyl having 1 to 20 carbon atoms. |
| $R_{10}(CH_2CH_2O)_{q'}OSO_3H$ | $R_{10}$: alkyl having 1 to 20 carbon atoms. q': zero or integer of 1 to 15. |
| $R_{11}$, $R_{12}$, $SO_3H$ | $R_{11}$: hydrogen atom or alkyl having 1 to 20 carbon atoms. $R_{12}$: hydrogen atom or alkyl having 1 to 3 carbon atoms |

More specific examples of the useful organic acids are acetic acid, 2-ethylhexanoic acid, n-octanoic acid, lauric acid, stearic acid and like fatty acids; dioctylphosphoric acid, dilaurylphosphoric acid and like dialkylphosphoric acid; dipolyhydroxyethylene (4) butylether phosphate (wherein the number in the parentheses represent the total number of ethylene oxide forming two polyhydroxyethylene groups, same as hereinafter), dipolyhydroxyethylene(6)octyl ether phosphate, dipolyhydroxyethylene(6)hexadecylether phosphate, dipolyhydroxyethylene(10)laurylether phosphate, dipolyhydroxyethylene(10)oleylether phosphate, dipolyhydroxyethylene(18)stearylether phosphate and like dipolyhydroxyethylenealkylether phosphates; N-acetylsarcosine, N-octanoylsarcosine, N-lauroylsarcosine, N-myristoylsarcosine, N-oleylsarcosine and like N-acylsarcosines; dibutylsulfosuccinate, di-(2-ethylhexyl)sulfosuccinate, di-(n-octyl)sulfosuccinate, distearylsulfosuccinate and like dialkylsulfosuccinates; octyl sulfate, lauryl sulfate, stearyl sulfate and like alkyl sulfates; polyhydroxyethylene(3)octyl sulfate (wherein the number in the parentheses following the polyhydoxyethylene represents the number of ethylene oxide added, same as hereinafter), polyhydroxyethylene(3-)lauryl sulfate, polyhydroxyethylene(5)myristyl sulfate, polyhydroxyethylene(10)stearyl sulfate, polyhydroxyethylene(15)oleyl sulfate and like polyhydroxylethylenealkyl sulfates; benzenesulfonic acid, p-toluenesulfonic acid, dodecylbenzenesulfonic acid, stearylbenzenesulfonic acid and like alkylbenzenesulfonic acids; etc.

The method of preparing amine salts from the monoamines represented by the formula (I) and organic acids is not particularly limited. Generally the amine salt is obtained by the usual acid-base reaction with use of about 1 mole of the organic acid per mole of the monoamine.

Similarly the organic acid salts of the diamines useful in this invention and represented by the formula (II) are prepared by the usual acid-base reaction between the diamines and organic acids.

In the formula (II) representing the diamines, $R_4$ is alkyl having 6 to 20, preferably 8 to 20, carbon atoms. The alkyl may be in the form of a straight chain or branched chain, or may be saturated or unsaturated alkyl. $R_5$ may be straight-chain or branched-chain, saturated or unsaturated alkylene having 2 to 6 carbon atoms. $R_2$ is hydrogen atom or methyl. The constituents $R_2$ contained in one molecule of the diamine may all be either hydrogen atoms or methyl groups or may comprise both hydrogen atom and methyl group. $l$, $m$ and $n$ are each zero or an integer of 1 to 20, and $3 \leqq l + m + n \leqq 20$. When at least one of $l$, $m$ and $n$ is not smaller than 2, the resulting composition will have excellent properties. More preferably, $l$, $m$ and $n$ are such that $5 \leqq l + m + n \leqq 15$. If $l + m + n$ is less than 3, it is difficult to achieve the desired effect of this invention.

Typical of the diamines of the formula (II) are listed in Table 3 below.

Table 3

| Compound No. | $R_4$ | $R_5$ | $R_2$ | l + m + n |
|---|---|---|---|---|
| 1 | $C_6H_{13}$ | $(CH_2)_2$ | H | 3 |
| 2 | $C_8H_{17}$ | $(CH_2)_3$ | H | 4 |
| 3 | $C_{12}H_{25}$ | $(CH_2)_3$ | H | 6 |
| 4 | $C_{12}H_{25}$ | $(CH_2)_4$ | H | 6 |
| 5 | $C_{12}H_{25}$ | $(CH_2)_2$ | $CH_3$ | 3 |
| 6 | $C_8H_{17}$ | $(CH_2)_4$ | H | 15 |
| 7 | $C_8H_{17}$ | $-CH_2-CH(CH_3)-$ | H | 8 |
| 8 | $C_{18}H_{17}$ | $(CH_2)_4$ | H | 3 |
| 9 | $C_{18}H_{35}$ | $(CH_2)_2$ | H | 12 |
| 10 | $C_{18}H_{35}$ | $(CH_2)_2$ | H | 10 |
| 11 | $C_{18}H_{35}$ | $(CH_2)_3$ | H | 15 |
| 12 | $C_{18}H_{37}$ | $(CH_2)_3$ | H | 10 |
| 13 | $C_{18}H_{37}$ | $(CH_2)_3$ | H | 5 |
| 14 | $C_{12}H_{25}$ | $(CH_2)_4$ | H | 10 |
| 15 | Beef tallow alkyl | $(CH_2)_3$ | H | 10 |
| 16 | " | $(CH_2)_6$ | H | 10 |

The diamines of the formula (II) further contains the following compound.

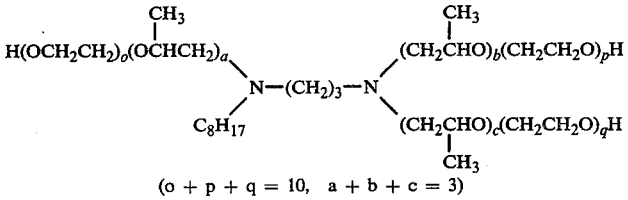

$(o + p + q = 10,\ a + b + c = 3)$

The organic acids to be reacted with the diamines of the formula (II) to form organic acid salts are the same as those used for forming the organic acid salts by being reacted with the amines of the formula (I). Generally the amine salt is obtained by the usual acid-base reaction with use of about 1 to 2 moles of the organic acid per mole of the diamine. The preferred examples of the acids are the same as those preferable for forming the salts ofthe amines (I). Further the reaction between the diamines and the organic acids is conducted under the same conditions as in the foregoing reaction.

The organic acid salts of the amines represented by the formulae (I) and (II) are used in such amounts that the concentration of the salt in the fluorine-containing hydrocarbon solvent used for dry cleaning is at least about 0.05% by weight, preferably about 0.05 to about 5% by weight.

According to this invention, the organic acid salts of the monoamines of the formula (I) and the organic acid salts of the diamines of the formula (II) are each used singly. These two kinds of salts are also conjointly usable. These two kinds of organic acid salts, even when used singly, result in an excellent dry cleaning effect and permit water to be solubilized or emulsified in the solvent with high stability. When the two kinds of the organic acid salts are conjointly used, water can be solubilized or emulsified in the solvent with higher stability than when either kind of them is used singly. In this case the organic acid salts of the diamines (II) may be used in an amount of more than 40% by weight, preferably more than 50% by weight, based on the mixture of the organic acid salts of the diamines (II) and (I).

The fluorine-containing hydrocarbons to usually used in this invention are those in which fluorine atoms and chlorine atoms are both substituted for some of the hydrogen atoms. Examples are trichloromonofluoromethane, 1,1,2-trichloro-1,2,2-trifluoroethane, 1,1,2,2-tetrachlorodifluoroethane and 1,1-dichloro-2,2,2-trifluoroethane, etc., among which 1,1,2-trichloro-1,2,2-trifluoroethane is preferable.

When at least one of the organic acid salts of the amines of the formulae (I) and (II) is incorporated in the solvent, the resulting composition produces an outstanding dry cleaning effect. In addition, water can be rendered solubilizable in the fluorine-containing hydrocarbon solvent with improved stability when the present composition contains a sulfonate represented by the formula $$R_{13}—SO_3M \qquad \text{(III)}$$

wherein $R_{13}$ is alkyl having 1 to 20 carbon atoms, phenyl, alkyl-substituted phenyl, $$R_{14}OCOCH_2 \atop R_{14}OCOCH— \quad \text{or} \quad R_{14}(CH_2CH_2O)_qO—$$

wherein $R_{14}$ is alkyl having 1 to 20 carbon atoms, and M is alkali metal or ammonium group, $q$ is an integer of 1 to 20.

In the formula (III) the alkyl represented by $R_{13}$ and $R_{14}$ has 1 to 20 carbon atoms, preferably 8 to 20 carbon atoms, and may be a straight-chain or branched-chain, saturated or unsaturated one. Preferable examples of the sulfonates of the formula (III) are sodium di(n-butyl)sulfosuccinate, potassium di(sec-butyl)sulfosuccinate, ammonium dihexylsulfosuccinate, sodium di(n-octyl)sulfosuccinate, sodium di(2-ethylhexyl)sulfosuccinate, potassium dilaurylsulfosuccinate, ammonium dioleylsulfosuccinate and like sulfosuccinates; sodium octylsulfonate, potassium laurylsulfonate, ammonium myristylsulfonate, sodium stearylsulfonate and like alkylsulfonates; and sodium p-toluenesulfonate, ammonium hexylbenzenesulfonate, potassium nonylbenzenesulfonate, sodium dodecylbenzenesulfonate, ammonium pentadecylbenzenesulfonate, etc., among which sodium di(2-ethylhexyl)sulfosuccinate and sodium dodecylbenzenesulfonate are especially preparable.

The sulfonate of the formula (III) is used in an amount of less than 50% by weight, preferably up to 40% by weight, based on the total amount of the organic acid salt(s) and the sulfonate.

The present compositions may further contain other surfactants which are generally used. Examples are alkylamine salts of alkylsulfuric acid and alkylbenzenesulfonic acid, alkylamine salts of higher fatty acids, matal salts and like ionic surfactants, polyhydroxyethylenealkylphenylethers, polyhydroxyethylene-fatty acid esters, sorbitol esters and like nonionic surfactants. Preferable nonionic surfactants are those having HLB of up to 15. When these ionic surfactants and/or nonionic surfactants are used conjointly with at least one of the organic acid salts of the amines of the formulae (I) and (II), the surfactant(s) will be used in an amount of less than 50% by weight, preferably up to 40% by weight, based on the total amount of the salt and the surfactant.

The dry cleaning composition of this invention are suited for cleaning not only natural fibers such as silk, cotton, hemp, etc. but also synthetic fibers such as polyester fibers, polyamide fibers (nylon), etc. The fibers thus cleaned with the dry cleaning composition of this invention are excellent in anti-static charge.

EXAMPLE 1

Dry cleaning compositions of this invention are prepared by dissolving the organic acid salts listed in Table 4 in 400 ml portions of 1,1,2-trichloro-1,2,2-trifluoroethane solvent respectively. The salts are used in amounts each corresponding to a concentration of 0.5% by weight.

Table 4

| | Salt of Organic Acid | | | | | |
|---|---|---|---|---|---|---|
| | Amine of the formula (I) | | | | | Molar |
| No. | R1 | R2 | R3 | m + n | Organic Acid | ratio |
| 1 | $C_{18}H_{35}$ | H | H | 5 | $C_{12}H_{25}O(CH_2CH_2O)_3$ > POOH, $C_{12}H_{25}O(CH_2CH_2O)_3$ | 1:1 |
| 2 | $C_{18}H_{35}$ | H | H | 5 | $C_8H_{17}OCOCH_2$ \| $C_8H_{17}OCOCHSO_3H$ | 1:1 |
| 3 | $C_{18}H_{37}$ | H | H | 15 | $C_{17}H_{35}CONCH_2COOH$ \| $CH_3$ | 1:1 |
| 4 | $C_8H_{17}$ | H | $C_8H_{17}$ | 3 | $C_{12}H_{25}(CH_2CH_2O)_3OSO_3H$ | 1:1 |

Table 4-continued

| No. | Salt of Organic Acid: Amine of the formula (I) R1 | R2 | R3 | m + n | Organic Acid | Molar ratio |
|---|---|---|---|---|---|---|
| 5 | $C_6H_{13}$ | H | H | 3 | 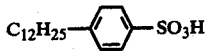 | 1:1 |
| 6 | $C_{14}H_{29}$ | H | H | 10 | $C_{12}H_{25}OSO_3H$ | 1:1 |
| 7 | $C_{18}H_{35}$ | $CH_3$ | H | 5 | $C_7H_{15}COOH$ | 1:1 |

The following tests are conducted with use of the compositions obtained. The percentages are all by weight.

1. Cleaning test

Table 5

| Salt of Organic Acid | | 1 A | 1 B | 2 A | 2 B | 3 A | 3 B | 4 A | 4 B | 5 A | 5 B | 6 A | 6 B | 7 A | 7 B | Nothing A | Nothing B |
|---|---|---|---|---|---|---|---|---|---|---|---|---|---|---|---|---|---|
| Cotton | (i)*1 | 30 | 82 | 39 | 86 | 32 | 78 | 28 | 76 | 33 | 83 | 35 | 83 | 29 | 80 | 0.7 | 68 |
| | (ii)*2 | 24 | 92 | 34 | 94 | 28 | 92 | 23 | 90 | 29 | 91 | 30 | 92 | 23 | 90 | 16 | 89 |
| Wool | (i)*1 | 39 | 78 | 56 | 93 | 43 | 82 | 38 | 81 | 42 | 82 | 44 | 86 | 37 | 77 | 6.1 | 76 |
| | (ii)*2 | 42 | 92 | 53 | 95 | 48 | 90 | 42 | 90 | 44 | 93 | 45 | 93 | 41 | 91 | 18 | 88 |
| Polyester | (i)*1 | 42 | 80 | 63 | 89 | 44 | 78 | 40 | 78 | 43 | 80 | 43 | 82 | 40 | 78 | 3.4 | 65 |
| | (ii)*2 | 30 | 94 | 46 | 94 | 40 | 90 | 29 | 92 | 31 | 92 | 32 | 92 | 29 | 90 | 14 | 87 |
| Nylon | (i)*1 | 42 | 78 | 68 | 91 | 44 | 82 | 41 | 76 | 45 | 81 | 47 | 83 | 40 | 76 | 0 | 66 |
| | (ii)*2 | 42 | 94 | 53 | 95 | 52 | 92 | 42 | 93 | 43 | 94 | 46 | 94 | 41 | 93 | 20 | 92 |

*1Water - soluble soiling composition
*2Oil - soluble soiling composition

Test pieces, 4 cm × 5 cm, are prepared from four kinds of fabrics, i.e. cotton, wool, nylon and polyester fabrics, commercially available for fiber testing. The test pieces are treated with 0.7 g of an oily soiling composition, 1 g of liquid paraffin containing 5% of molybdenum disulfide and 125 ml of perchloroethylene in the container of a cleaning device of the Launder-Ometer type at 30° C. for 15 minutes. The soiling composition is composed of 10% of stearic acid, 10% of oleic acid, 10% of oleyl alcohol, 10% of cholesterol, 40% of sodium chloride, 10% of tristearin and 10% of stearyl alcohol. Immediately after the treatment, the test pieces are withdrawn from the device, rinsed with water for 10 minutes, dewatered by being placed between sheets of dry cotton cloth and further allowed to dry on filter paper. The test pieces are thereafter immersed in a 3% aqueous solution of Procion Black HN (product of ICI Ltd.) serving as a water-soluble soiling composition, then withdrawn from the solution and dried on filter paper.

The test pieces are subjected to cleaning test with use of a Launder-Ometer (Model C-20, product of Showa Juki Co., Ltd., Japan).

The test pieces treated as above and pieces of unsoiled fabric are placed in 400 ml of the composition of this invention and cleaned at 25° C. for 20 minutes. After the cleaning, the pieces are dried at room temperature.

Reflectance measurements are made before and after the cleaning procedure with use of a reflectometer (Model RM-50, product of Murakami Color Technique Research Institute, Japan), and cleaning efficiency and soil redeposition preventing efficiency are calculated from the following equations.

$$\text{Cleaning efficiency } (A) = \frac{E - C}{D - C} \times 100$$

$$\text{Soil redeposition preventing efficiency } (B) = \frac{F}{D} \times 100$$

where

C: Reflectance of test piece before cleaning.

D: Reflectance of unsoiled piece after cleaning.

E: Reflectance of test piece after cleaning.

F: Reflectance of unsoiled piece after cleaning.

Table 5 shows the results.

Table 5 reveals that the cleaning compositions of this invention produce an outstanding cleaning effect on various fabrics and effectively prevent redeposition of soil thereon.

2. Water-solubilizing test

Two g of the surfactant shown in Table 4 is placed into a 200-ml flask, 0.4 g of pure water is added to the surfactant, 6 g of trichlorotrifluoroethane is further placed into the flask, and the mixture is fully shaken to solubilize the water. Trichlorotrifluoroethane is further placed into the flask to obtain 100 g of a mixture, which will be referred to as Specimen A-I.

Subsequently a 10 g portion of Specimen A-I is placed into a 200-ml flask, and trichlorotrifluoroethane is added to the specimen to obtain 100 g of a mixture (Specimen A-II).

Specimens A-I and A-II are allowed to stand at room temperature for 3 days and thereafter observed.

Table 6 shows the results. The specimen which remained transparent free of any changes is marked O, while the specimen which became white and turbid or separated is marked X.

Table 6

| Solubilized specimen | Salt of organic acid: 2 | 3 | 5 | 6 | Nothing |
|---|---|---|---|---|---|
| A - I | 0 | 0 | 0 | 0 | X |
| A - II | 0 | 0 | 0 | 0 | X |

3. Test for measuring antistatic effect

A 0.5 g quantity of the surfactant shown in Table 4 is dissolved in 1,1,2-trichloro-1,2,2-trifluoroethane to prepare 500 g of a solution. Test pieces of cotton, silk, wool, acetate, nylon and polyester are immersed in the solution for 30 minutes, dried at 40° C. and then allowed to stand overnight in a constant temperature constant humidity chamber (20° C., RH 65%) to obtain test pieces. The electrostatic charges on the test pieces are measured with use of a rotary static tester as a measuring device and a tetrafluoroethylene-hexafluoropropene copolymer resin film (product of DAIKIN KOGYO CO. Ltd.) as a rubbing piece. Table 7 shows the results.

Table 7

| Salt of Organic Acid | Cotton | Silk | Wool | Acetate | Nylon | Polyester |
|---|---|---|---|---|---|---|
| 2 | 93 | 115 | 95 | 107 | 108 | 93 |
| 3 | 103 | 123 | 123 | 127 | 103 | 97 |
| 5 | 133 | 143 | 133 | 140 | 120 | 115 |
| 6 | 115 | 132 | 128 | 130 | 110 | 105 |
| Nothing | 160 | 1,600 | 420 | 2,000 | 1,200 | 200 |

EXAMPLE 2

Dry cleaning compositions are prepared by dissolving the organic acid salts listed in Table 8 in 400 ml portions of 1,1,2-trichloro-1,2,2-trifluoroethane solvent respectively. The salts are used in amounts each corresponding to a concentration of 0.5% by weight.

Table 8

| | Salt of Organic Acid | | | | | |
|---|---|---|---|---|---|---|
| | Amine of the formula (II) | | | | | Mole |
| No. | $R_2$ | $R_5$ | $R_4$ | 1+m+n | Organic Acid | ratio |
| 1 | H | $(CH_2)_2$ | $C_{18}H_{35}$ | 12 | 2-ethylhexanoic acid | 1:2 |
| 2 | $CH_3$ | $(CH_2)_2$ | $C_{12}H_{25}$ | 3 | dipolyhydroxyethylene(6) octyl ether phosphate | 1:1.5 |
| 3 | H | $(CH_2)_3$ | beef tallow alkyl | 10 | di-(2-ethylhexyl) sulfosuccinate | 1:2 |
| 4 | H | $(CH_2)_3$ | $C_{18}H_{37}$ | 15 | N-oleysarcosine | 1:1 |
| 5 | H | $CH_3$ \| $CH_2CH$ | $C_8H_{17}$ | 8 | Laurylether phosphate | 1:2 |
| 6 | H | $(CH_2)_5$ | $C_{12}H_{25}$ | 6 | dodecylbenzenesulfonic acid | 1:1 |
| 7 | H | $(CH_2)_6$ | beef tallow | 10 | di-(2-ethyl- | |

Table 8-continued

| | Salt of Organic Acid | | | | | |
|---|---|---|---|---|---|---|
| | Amine of the formula (II) | | | | | Mole |
| No. | $R_2$ | $R_5$ | $R_4$ | 1+m+n | Organic Acid | ratio |
| | | | alkyl | | hexyl) sulfosuccinate | 1:1.5 |

Cleaning test and water-solubilizing test are conducted in the same manner as in Example 1 using the above compositions. The results are shown in Tables 9 and 10 respectively. Also antistatic effect is measured in the same manner as in Example 1 to give the results shown in Table 11.

Table 9

| Salt of Organic Acid | | 1 | | 2 | | 3 | | 4 | | 5 | | 6 | | 7 | | Nothing | |
|---|---|---|---|---|---|---|---|---|---|---|---|---|---|---|---|---|---|
| | | A | B | A | B | A | B | A | B | A | B | A | B | A | B | A | B |
| Cotton | (i)*1 | 30 | 75 | 30 | 80 | 38 | 88 | 31 | 76 | 32 | 75 | 34 | 81 | 37 | 87 | 0.7 | 68 |
| | (ii)*2 | 26 | 90 | 27 | 91 | 35 | 94 | 31 | 92 | 28 | 92 | 28 | 92 | 33 | 93 | 16 | 89 |
| Wool | (i)*1 | 44 | 84 | 40 | 80 | 55 | 95 | 39 | 79 | 45 | 83 | 47 | 86 | 53 | 93 | 6.1 | 76 |
| | (ii)*2 | 48 | 91 | 42 | 90 | 54 | 96 | 42 | 89 | 47 | 91 | 49 | 92 | 51 | 94 | 18 | 88 |
| Polyester | (i)*1 | 47 | 75 | 41 | 76 | 60 | 90 | 39 | 78 | 48 | 78 | 50 | 83 | 56 | 88 | 3.4 | 65 |
| | (ii)*2 | 38 | 90 | 40 | 91 | 45 | 93 | 33 | 88 | 41 | 90 | 42 | 91 | 42 | 92 | 14 | 87 |
| Nylon | (i)*1 | 40 | 80 | 42 | 78 | 66 | 91 | 39 | 79 | 46 | 80 | 53 | 82 | 61 | 89 | 0 | 66 |
| | (ii)*2 | 43 | 92 | 43 | 93 | 53 | 96 | 40 | 92 | 47 | 93 | 46 | 93 | 50 | 95 | 20 | 92 |

*1 and *2 are the same as in Table 5.

Table 10

| Solubilized specimen | Salt of organic acid | | | | | |
|---|---|---|---|---|---|---|
| | 1 | 3 | 4 | 6 | 7 | Nothing |
| A - I | 0 | 0 | 0 | 0 | 0 | X |
| A - II | 0 | 0 | 0 | 0 | 0 | X |

Table 11

| Salt of Organic Acid | Cotton | Silk | Wool | Acetate | Nylon | Polyester |
|---|---|---|---|---|---|---|
| 1 | 90 | 108 | 93 | 134 | 140 | 145 |
| 3 | 100 | 111 | 113 | 132 | 138 | 128 |
| 4 | 92 | 126 | 103 | 135 | 139 | 108 |
| 6 | 98 | 112 | 100 | 136 | 141 | 110 |
| Nothing | 160 | 1,600 | 420 | 2,000 | 1,200 | 200 |

EXAMPLE 3

Dry cleaning compositions of this invention are prepared by dissolving the compounds listed in Table 12 in 400 ml portions of 1,1,2-trichloro-1,2,2-trifluoroethane solvent respectively. The compounds are used in an amounts each corresponding to a concentration of 0.5% by weight.

Table 12

| No. | Salt of Organic Acid | % (by weight) |
|---|---|---|
| 1 | Reaction product of polyhydroxyethylene(10) stearyltrimethylenediamine and di(2-ethylhexyl)sulfosuccinate in a molar ratio of 1:1.5. | 60 |
| | Reaction product of polyhydroxyethylene (5) oreylamine and dodecylbenzenesolfonic acid in a molar ratio of 1 : 1. | 40 |
| | Reaction product of polyhydroxyethylene (5)-nonyltrimethylenediamine and di(2-ethylhexyl)sulfosuccinate in a molar ratio of 1:1.3. | 75 |
| 2 | Reaction product of polyhydroethylene (10) stearylamine and di(2-ethylhexyl)sulfosuccinate in a molar ratio of 1:1. | 10 |
| | Sorbitanmonooreate | 15 |
| | Reaction product of polyhydroxyethylene (10) beef tallow alkyltrimethylenediamine and lauryl sulfate in a molar ratio of 1:2. | 50 |
| 3 | Reaction product of polyhydroxyethylene (2) laurylamine and stearic acid in a molar ratio of 1:1. | 30 |
| | Sodium di-(2-ethylhexyl)sulfosuccinate. | 20 |
| 4 | Reaction product of polyhydroxyethylene (6)-lauryltetramethylenediamine and 2-ethylhexanoic acid in a molar ratio of 1:1.5. | 40 |
| | Reaction product of polyhydroxyethylene (3) octylamine and N-oreylsarcosine in a molar ratio of 1:1. | 30 |
| | Potassium dodecylbenzene sulfonate. | 30 |
| | Reaction product of polyhydroxyethylene (10)-stearyltrimethylenediamine and di-(2-ethylhexyl)sulfosuccinic acid | 50 |

Table 12-continued

| No. | Salt of Organic Acid | % (by weight) |
|---|---|---|
| | in a molar ratio of 1:1.5. | |
| 5 | Reaction product of polyhydroxyethylene (5) beef tallow alkylamine and dodecylbenzenesulfonic acid in a molar ratio of 1 : 1. | 30 |
| | Polyhydroxyethylene (2) nonylphenylether. | 20 |
| | Reaction product of polyhydroxyethylene (10) nonyldimethylenediamine and dilaurylsulfosuccinic acid in a molar ratio of 1:1.5. | 60 |
| | Reaction product of polyhydroxyethylene (5) oreylamine and | |
| 6 | di(2-ethylhexyl) sulfosuccinic acid in a molar ratio of 1:1. | 25 |
| | Polyhydroxyethylene (4) stearate | 10 |
| | Reaction product of dodecylbenzenesulfonic acid and sec-butylamine in a molar ratio of 1:1 | 5 |

Cleaning test is conducted in the same manner as in Example 1 and Water-solubilizing test is conducted by the following method using the above compositions. The results are shown in Tables 13 and 14.

Water-solubilizing test (A) Two g of the surfactant shown in Table 12 is placed into a 200-ml flask, 2 g of pure water is added to the surfactant, 6 g of trichlorotrifluoroethane is further placed into the flask, and the mixture is fully shaken to solubilize the water. Trichlorotrifluoroethane is further placed into the flask to obtain 100 g of a mixture, which will be referred to as Specimen A-I.

Subsequently a 10 g portion of Specimen A-I is placed into a 200-ml flask, and trichlorotrifluoroethane is added to the specimen to obtain 100 g of a mixture (Specimen A-II).

(B) Two g of the same surfactant as used above is placed into a 200-ml of flask, 1 g of pure water is added to the surfactant, 6 g of trichlorotrifluoroethane is further added, and the mixture is fully shaken. Exactly the same procedure as in A) is thereafter followed to prepare Specimen B-I and Specimen B-II.

Specimens A-I, A-II, B-I and B-II are allowed to stand at room temperature for 3 days and thereafter observed.

Table 13

| Salt of Organic Acid | | 1 | | 2 | | 3 | | 4 | | 5 | | 6 | | Nothing | |
|---|---|---|---|---|---|---|---|---|---|---|---|---|---|---|---|
| | | A | B | A | B | A | B | A | B | A | B | A | B | A | B |
| Cotton | (i)*1 | 40 | 87 | 38 | 87 | 36 | 85 | 29 | 84 | 40 | 88 | 37 | 86 | 0.7 | 68 |
| | (ii)*2 | 38 | 91 | 35 | 93 | 35 | 90 | 28 | 91 | 39 | 92 | 35 | 90 | 16 | 89 |
| Wool | (i)*1 | 56 | 94 | 56 | 95 | 52 | 93 | 47 | 91 | 56 | 95 | 54 | 92 | 6.1 | 76 |
| | (ii)*2 | 53 | 96 | 54 | 95 | 50 | 94 | 43 | 94 | 52 | 96 | 53 | 93 | 18 | 88 |
| Polyester | (i)*1 | 61 | 90 | 60 | 92 | 58 | 90 | 52 | 90 | 62 | 91 | 60 | 90 | 3.4 | 65 |
| | (ii)*2 | 44 | 92 | 47 | 93 | 41 | 94 | 40 | 92 | 45 | 91 | 44 | 91 | 14 | 87 |
| Nylon | (i)*1 | 65 | 88 | 66 | 91 | 62 | 87 | 56 | 86 | 65 | 89 | 64 | 89 | 0 | 66 |
| | (ii)*2 | 53 | 96 | 53 | 97 | 52 | 95 | 53 | 94 | 54 | 96 | 52 | 94 | 20 | 92 |

*1 and *2 are the same as in Table 5.

Table 14

| Solubilized specimen | Salt of organic acid | | | | | |
|---|---|---|---|---|---|---|
| | 1 | 2 | 3 | 4 | 5 | Nothing |
| A - I | X | O | O | O | O | X |
| A - II | X | X | O | O | X | X |
| B - I | O | O | O | O | O | X |
| B - II | O | O | O | O | O | X |

What we claim is:

1. A dry cleaning composition comprising an effective components a fluorine-containing hydrocarbon solvent and at least one surfactant dissolved in said solvent and selected from the group consisting of organic acid salts of monoamines represented by the formula

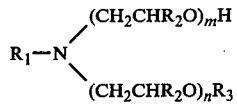

(I)

wherein $R_1$ is alkyl having 6 to 20 carbon atoms, $R_2$ is hydrogen atom or $CH_3$, $m$ and $n$ are each zero or an integer of 1 to 20, and are further defined by $3 \leqq m + n \leqq 20$, $R_3$ is hydrogen atom or alkyl having 6 to 20 carbon atoms when $n$ is zero and $R_3$ is hydrogen atom when $m$ is 1 to 20, and organic acid salts of diamines represented by the formula

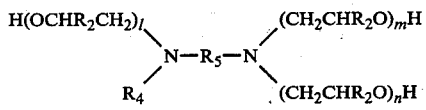

(II)

wherein $R_2$ is as defined above, $R_4$ is alkyl having 6 to 20 carbon atoms, $R_5$ is alkylene having 2 to 6 carbon atoms, $l$ is zero or an integer of 1 to 20, $m$ and $n$ are as defined above, and $3 \leqq l + m + n \leqq 20$, said surfactant being present in an amount of from 0.05 to 5% by weight in the fluorine-containing solvent.

2. A dry cleaning composition as defined in claim 1 wherein the concentration is 0.5 to 5% by weight.

3. A dry cleaning composition as defined in claim 1 wherein $m$ and $n$ in the formula (I) are defined by $5 \leqq m + n \leqq 15$.

4. A dry cleaning composition as defined in claim 1 wherein at least one of $l$, $m$ and $n$ in the formula (II) is an integer of not smaller than 2.

5. A dry cleaning composition as defined in claim 1 wherein $l$, $m$ and $n$ in the formula (II) are defined by $5 \leqq l + m + n \leqq 15$.

6. A dry cleaning composition as defined in claim 1 wherein the fluorine-containing hydrocarbon solvent is at least one of trichloromonofluoromethane, 1,1,2-trichloro-1,2,2-trifluoroethane, 1,1,2,2-tetrachlorodifluoroethane and 1,1-dichloro-2,2,2-trifluoroethane.

7. A dry cleaning composition as defined in claim 1 wherein said surfactant is at least one species selected from organic acid salts of monoamines represented by the formula

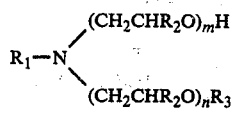

(I)

wherein $R_1$ is alkyl having 6 to 20 carbon atoms, $R_2$ is hydrogen atom or $CH_3$, $m$ and $n$ are each zero or an integer of 1 to 20, and are further defined by $3 \leqq m + n \leqq 20$, $R_3$ is hydrogen atom or alkyl having 6 to 20 carbon atoms when $n$ is zero and $R_3$ is hydrogen atom when $m$ is 1 to 20.

8. A dry cleaning composition as defined in claim 1 wherein said surfactant is at least one species selected from organic acid salts of diamines represented by the formula

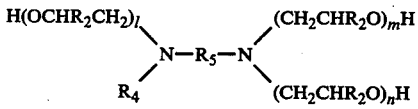

(II)

wherein $R_2$ is as defined above, $R_4$ is alkyl having 6 to 20 carbon atoms, $R_5$ is alkylene having 2 to 6 carbon atoms, $l$ is zero or an integer of 1 to 20, $m$ and $n$ are as defined above, and $3 \leqq l + m + n \leqq 20$.

9. A dry cleaning composition as defined in claim 1 wherein said surfactant is a mixture of at least one species selected from organic acid salts of monoamines represented by the formula

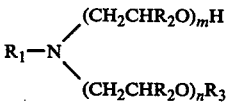

(I)

wherein $R_1$ is alkyl having 6 to 20 carbon atoms, $R_2$ is hydrogen atom or $CH_3$, $m$ and $n$ are each zero or an integer of 1 to 20, and are further defined by $3 \leqq m + n \leqq 20$, $R_3$ is hydrogen atom or alkyl having 6 to 20 carbon atoms when $n$ is zero and $R_3$ is hydrogen atom when $m$ is 1 to 20, and at least one species selected from organic acid salts of diamines represented by the formula

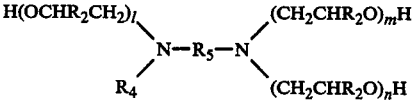

(II)

wherein $R_2$ is as defined above, $R_4$ is alkyl having 6 to 20 carbon atoms, $R_5$ is alkylene having 2 to 6 carbon atoms, $l$ is zero or an integer of 1 to 20, $m$ and $n$ are as defined above, and $3 \leqq l + m + n \leqq 20$.

10. A dry cleaning composition as defined in claim 9 wherein the organic acid salt of monoamines is used in an amount of less than 60 weight % based on the mixture.

11. A dry cleaning composition as defined in claim 1 wherein the organic acid is at least one of the acids represented by the formulae:

(i) $R_6COOH$ wherein $R_6$ is alkyl having 1 to 20 carbon atoms, (ii)

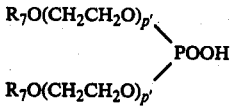

wherein $R_7$ is alkyl having 1 to 20 carbon atoms, and $p'$ is zero or an integer of 1 to 15, (iii)

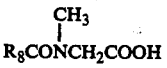

wherein $R_8$ is alkyl having 1 to 20 carbon atoms, (iv)

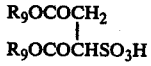

wherein $R_9$ is alkyl having 1 to 20 carbon atoms, (v) $R_{10}(CH_2CH_2O)_{p'}OSO_3H$ wherein $R_{10}$ is alkyl having 1 to 20 carbon atoms, $q'$ is zero or an integer of 1 to 15, and (vi)

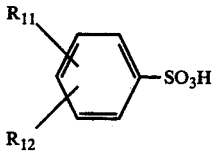

wherein $R_{11}$ is hydrogen atom or alkyl, and $R_{12}$ is hydrogen atom of alkyl having 1 to 3 carbon atoms.

12. A dry cleaning composition as defined in claim 11 wherein said organic acid is at least one of the acids represented by the formula

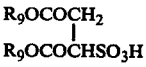

wherein $R_9$ is alkyl having 1 to 20 carbon atoms, and

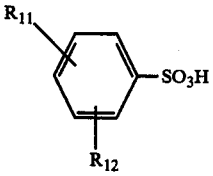

wherein $R_{11}$ is hydrogen atom or alkyl, and $R_{12}$ is hydrogen atom or alkyl having 1 to 3 carbon atoms.

13. A dry cleaning composition as defined in claim 12 wherein said organic acid is represented by the formula

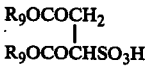

wherein $R_9$ is alkyl having 1 to 20 carbon atoms.

14. A dry cleaning composition as defined in claim 13 wherein the amount of the sulfonate is less than 50% by weight based on the total amount of at least one of the organic acid salts of the amines represented by the formulae (I) and (II) and the sulfonate.

15. A dry cleaning composition as defined in claim 1 further containing a sulfonate represented by the formula $$R_{13}—SO_3M \qquad \text{(III)}$$

wherein $R_{13}$ is alkyl having 1 to 20 carbon atoms, phenyl, alkyl-substituted phenyl, $$\begin{array}{l} R_{14}OCOCH_2 \\ \quad\quad | \\ R_{14}OCOCH— \end{array} \quad \text{or} \quad R_{14}(CH_2CH_2O)_qO—$$

wherein $R_{14}$ is alkyl having 1 to 20 carbon atoms, and M is alkali metal or ammonium salt, $q$ is an integer of 1 to 20.

16. A dry cleaning composition as defined in claim 15 wherein said sulfonate is sodium di(2-ethylhexyl)sulfosuccinate and/or sodium dodecylbenzenesulfonate.

* * * * *